US006248197B1

(12) United States Patent
Nakanishi et al.

(10) Patent No.: US 6,248,197 B1
(45) Date of Patent: Jun. 19, 2001

(54) METHOD FOR PRODUCING A SHAPED MULTIFILAMENT, NON-THERMOPLASTIC, ELASTOMERIC YARN

(75) Inventors: Hideki Nakanishi; Satoshi Wakisaka, both of Shiga; Yukio Ohta, Kyoto, all of (JP)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/405,040

(22) Filed: Sep. 24, 1999

Related U.S. Application Data

(62) Division of application No. 08/886,234, filed on Jul. 1, 1997, now abandoned.

(30) Foreign Application Priority Data

Jul. 2, 1996 (JP) ..... 8-190037

(51) Int. Cl.[7] ..... D01D 5/16; D01D 5/253; D01D 5/12

(52) U.S. Cl. ..... 156/180; 156/167; 156/296; 156/309.9; 156/322; 264/210.8

(58) Field of Search ..... 156/166, 167, 156/180, 296, 308.2, 309.9, 322; 57/248, 251, 242; 264/210.8

(56) References Cited

U.S. PATENT DOCUMENTS

| | | | | |
|---|---|---|---|---|
| 3,690,978 | * | 9/1972 | Nishizawa et al. | 156/167 |
| 3,777,470 | * | 12/1973 | Suzuki et al. | 156/167 X |
| 5,000,899 | * | 3/1991 | Dreibelbis et al. | 264/210.8 X |
| 5,362,433 | * | 11/1994 | Toscan et al. | 264/210.8 |
| 5,387,387 | * | 2/1995 | James et al. | 264/211.12 X |

FOREIGN PATENT DOCUMENTS

| | | |
|---|---|---|
| 53-139847 | 12/1978 | (JP) . |
| 4-174717 | 6/1992 | (JP) . |
| 7-197318 | 12/1993 | (JP) . |
| 97A96090 | 7/1996 | (JP) . |

* cited by examiner

*Primary Examiner*—Jeff H. Aftergut
(74) *Attorney, Agent, or Firm*—George A. Frank

(57) ABSTRACT

The present invention provides a method for producing multifilament elastomeric yarn of modified cross-sectional shape and surface by hot-pressing a coalesced elastomeric multifilament yarn between rolls, thereby modifying the cross-sectional shape and/or surface of the multifilament.

5 Claims, 4 Drawing Sheets

METHOD FOR PRODUCING A SHAPED MULTIFILAMENT, NON-THERMOPLASTIC, ELASTOMERIC YARN

This is a division of application Ser. No. 08/886,234 filed Jul. 1, 1997, now abandoned.

FIELD OF THE INVENTION

This invention relates to a method for fabricating multifilament elastomeric yarns from elastomeric polymers, and especially to a method for fabricating said elastomeric yarn in which the surface and the cross-sectional shapes have been stably modified.

DESCRIPTION OF THE PRIOR ART

Japanese Published Unexamined Patent Application No. 53-139,847 (1978) proposes a melt-spinning method in which a thermoplastic polyurethane multifilament is fused during spinning so as to unite in the lengthwise direction a plurality of filaments and thereby form a monofilament. Japanese Published Unexamined Patent Application No. 7-197,318 (1995) proposes a method in which filaments of modified cross-section are produced by dry-spinning polyurethane, in which process spinning is carried out with a spinneret having a modified shape. However, in these prior art methods, the multifilament is fused into a monofilament during spinning. Moreover, no intention or suggestion whatsoever is expressed regarding modification of the cross-section of a coalesced elastomeric multifilament yarn.

SUMMARY OF THE INVENTION

The present invention provides a method for pressing a coalesced multifilament elastomeric yarn, and of producing multifilament elastomeric yarn in which the cross-sectional shape and surface have been modified.

The multifilament elastomeric yarn production method of the present invention is characterized by bundling and hot-pressing coalesced elastomeric multifilaments so as to modify the cross-sectional shape and optionally the surface of said multifilaments.

One or more types of elastomeric polymer can be selected from among synthetic rubbers, polyolefin elastomers, polyester elastomers and polyurethanes, although polyurethanes in particular are generally preferred in elastomeric yarns. Filaments of substantially round cross-section is generally coalesced during spinning to form a coalesced multifilament elastomeric yarn. The inventors found that, when such yarn is hot-pressed and shaped, for example flattened, high-quality, fashionable fabric that is truly soft and has a good hand can be produced from such modified yarn.

DETAILED DESCRIPTION OF PREFERRED EMBODIMENTS

Figure 1:
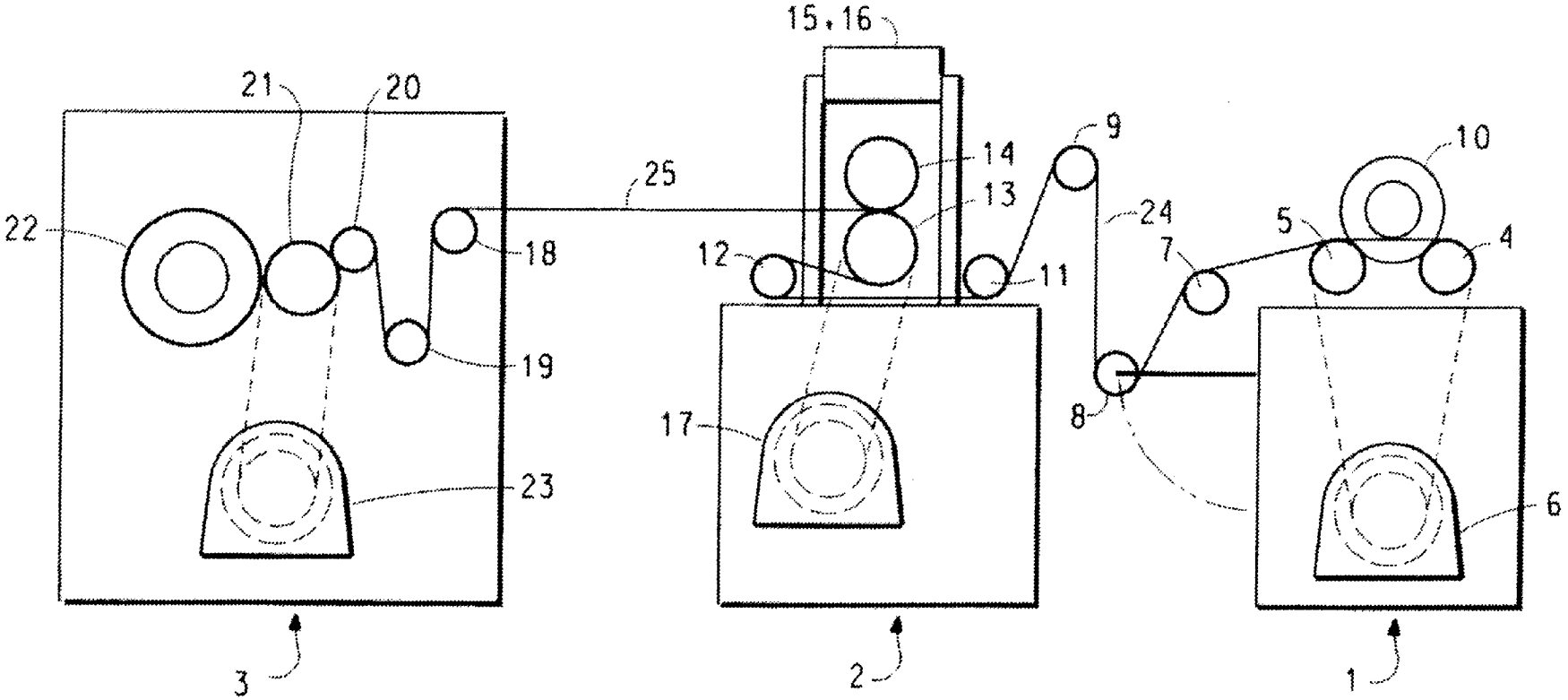
FIG. 1 is a side view of a backwinding apparatus that can be used in the method of the present invention.

The present invention shall now be described using polyurethanes as the elastomeric polymers. The polyurethanes in this invention may be either thermoplastic or they may be polyurethanes that are not thermoplastic.

The polyurethanes used to make the coalesced elastomeric yarn which is modified by the process of this invention can be prepared by reacting a polymeric glycol with a diisocyanate to produce a "capped" glycol which in turn is reacted with an organic diamine or organic diol chain extender and a monofunctional amine or alcohol as a chain terminator.

Diphenylmethane diisocyanate (hereinafter abbreviated as MDI) and hydrogenated MDI (HMDI) are preferred as the diisocyanate. The diisocyanate is not necessarily limited to one compound, it being possible to use mixed diisocyanates.

The polymeric glycols shall now be described. There is no particular restriction on the glycols. Typical known examples include polyether glycols such as polytetramethylene ether glycol (PTMEG) and copolymers thereof and polypropylene glycol and copolymers thereof; polyester glycols such as polybutylene adipate glycol and copolymers thereof; polycarbonate glycols; and polysiloxane glycols. The polymeric glycols are not limited to homopolymers, it being possible to use any suitable copolyether glycol or copolyester glycol. Copolyetherester glycols can also be used.

Preferred examples of polyether glycols include PTMEG and/or its copolymers. Typical examples of PTMEG copolymers include those in which ethylene oxide has been added at the ends of the PTMEG, and copolymer PTMEG comprising tetrahydrofuran (THF) and 3-methyl THF.

Other preferred polymeric glycols include polyester glycols having side groups such as methyl groups. Typical examples of these polymeric glycols include polymeric glycols which are the reaction products of neopentyl glycol with aliphatic dicarboxylic acids, and polycaprolactone glycols in which neopentyl glycol has been copolymerized.

Polymeric glycols having a molecular weight of 2,000–6,000 are preferably used. However, when it comes to polyols having no side chains, polyols having a molecular weight of 3,000–5,000 are preferred.

Known aliphatic, alicyclic and aromatic diamines may be used as the chain extender. Typical examples include ethylene diamine (EDA), 1,2- and 1,3-propylene diamine (PDA), butylene diamine (BDA), diethylene triamine, hexamethylene diamine, cyclohexane diamine, phenylene diamine, tolylene diamine, xylylene diamine, 3,3'-dichloro-4,4-biphenylamine, 2,6-diaminopyridine and 4,4'-diaminodiphenylmethane. EDA, 1,2-PDA and BDA are preferred.

Known aliphatic, alicyclic and aromatic diols may be used as the organic diol. Typical examples include ethylene glycol (EG), 1,3-propanediol (PDO), 1,4-butanediol (BDO), neopentyl glycol, 1,2-propylenediol, 1,4-cyclohexanediol, 1,4-cyclohexanedimethanol, 1,4-bis(β-hydroxyethoxy) benzene (BHEB), bis(β-hydroxyethyl)terephthalate, p-xylenediol, and mixtures thereof. EG, PDO, BDO and BHEB are preferred.

Known aliphatic, alicyclic and aromatic monofunctional amines and alcohols can be used as chain terminators. Typical examples include diethylamine, dimethylamine, ethanol, 1-propanol and 2-propanol.

The number-average molecular weight of the polyurethane used to make the coalesced multifilament elastomeric yarn which is modified by the method of the present invention preferably is 10,000–100,000, and more preferably 30,000–80,000. The polymer is dry-spun by conventional methods into filaments which are then coalesced (for example by air jets or other means) into a multifilament yarn. As used herein, "coalesced" refers to the condition of the multifilament yarn after it leaves the coalescence jets at the bottom of the spinning column and before it is shape-modified by the method of the present invention.

According to the method of the present invention, the coalesced polyurethane multifilament yarn is then bundled (for example, doubled) and hot-pressed, thereby at least partially fusing or pressure-bonding together the individual filaments of the multifilament, which causes them to bond in a suitable shape and modifies the cross-sectional shape and/or the surface shape of the multifilament. When this hot-pressing is carried out with a pressing member having a chosen shape, such as nipping-type hot rolls, the desired shape can be imparted. When nipping-type hot rolls that have a chosen shape are used, by pressing the multifilament while it is accommodated within grooves in the cylindrical surface of the rolls, the surface shape and cross-sectional shape of the multifilament can be modified as desired in accordance with the shape of the grooves. "Modified" is used here to refer to shapes which are one or more selected from among flattened, polygonal, star-like, horseshoe, elliptical, semicircular shapes, and the like.

By continuously or intermittently carrying out this hot pressing, the present invention provides a modified yarn. Moreover, by using pressing means with suitably embossed patterns on the pressing surface, an elastomeric yarn can be obtained that is marked along its length with these patterns. For example, when modification is carried out with pressing members having an indented surface, a flattened elastomeric yarn can be obtained. Any desired shaped groove or surface may be employed. If it is desired to modify a plurality of yarns, suitable modifications can be used in an apparatus used to carry out the method of this invention, for example by widening the pressing members to accommodate such plurality of yarns. If a shape is desired that requires a groove in a pressing member, a plurality of such grooves can be incorporated so that a plurality of yarns can be processed at one time by a single pair of pressing members.

The heating imparted during this hot pressing is carried out at a temperature of at least the softening point of this polyurethane but no more than its melting point. More specifically, this multifilament has the apparent form of a single yarn in which the respective monofilaments are lightly bonded; the bonding is carried out in a temperature range from about the temperature at which this light bond breaks to about the melting temperature. For example, although this differs depending on the polymer, in the case of polyurethaneurea, a temperature of 170–250° C. is preferred, with a temperature of about 200–230° C. being more preferred. Heating may consist of either a method whereby heating is carried out without contact with the elastomeric yarn (for example by using a nichrome wire heater or a far-infrared heater), or a method whereby the elastomeric yarn is heated by coming into direct contact with the surface of a hot roll or the like.

There is no particular restriction on the material of which these pressing members are made, although it is preferable that a material be used to which the softened or nearly melted elastomeric yarn does not readily stick. The pressing members can apply pressure in the lengthwise direction of the elastomeric yarn, in the lateral direction, or in a direction representing a combination of the two.

This hot-pressing step can be situated at any place from immediately below the spinning column in the multifilament spinning step to the winder. Alternatively, in the case of yarn that has been spun and wound into a spool or package, this hot pressing step may be performed at some point after initial winding, for example during a backwinding step or just before covering, knitting, and the like.

The multifilament spinning step in this invention is not limited to a specific technique. In the case of dry spinning, there is no limit on the temperature of the spinning solution, it being possible to use any suitable temperature. Nor does setting the spinning solution temperature at a level higher than the melting point or softening point of the polyurethane pose any particular problem. There is no particular restriction on the rate of spinning. Moreover, any spinneret hole shape can be used, and any suitable coalesced multifilament denier can be used. The number of filaments in the multifilament can be set at any number by changing the number of holes in the spinneret.

The spinning dope is discharged from the spinneret, following which it is heated to evaporate the solvent and form a filament. Heating may be carried out by heating from the spinning column walls, by means of a heated gas, or by a combination of the two. From the standpoint of efficiency, the use of both a heated gas and heating by the column walls is preferred. When a heated gas is used, there is no particular restriction on the method for supplying this heated gas. The shape of the column is not limited, and it may be circular, rectangular, square, or polygonal.

The heated gas should be suitably selected according to the type of volatiles generated during spinning. When such spinning volatiles are organic solvents, it is preferred that the heated gas consist primarily of gases that do not interact chemically with such solvents.

FIG. 1 shows one example of an apparatus that can be used to carry out the method of the present invention during a backwinding step. In this example, the multifilament cross-section-modifying device is comprised of a delivery section 1 where the elastomeric yarn is taken from the spool at a selected speed, a modifying section 2 that has two hot rolls for applying heat and pressure to modify the elastomeric yarn, and a windup section 3 that winds up the modified elastomeric yarn.

Delivery section 1 is comprised of driven first rolls 4 and 5, driving unit 6 that turns first rolls 4 and 5, freely rotatable guide rolls 7 and 9, and dancer roll 8 that is connected to a potentiometer for detecting the tension of the multifilament. The wound multifilament spool 10 is rotated by rolls 4 and 5, and the yarn is delivered at a selected speed to roll 7. Driving unit 6 is constructed such that the rotation of a speed-controlled electric motor is transferred to first rolls 4 and 5 by means such as a pulley and a belt.

Modifying section 2 is comprised of freely rotating guide rolls 11 and 1; driven hot press roll 13; hot press roll 14 which is mounted by means of bearings to two air cylinders 15 and 16 that have been mounted onto brackets so as to be parallel with hot press rolls 13 and 14; and drive unit 17 for rotating hot press roll 13. Drive unit 17 drives hot press roll 13 by a suitable means such as a pulley and a belt. Hot press rolls 13 and 14 may have grooves cut into their cylindrical surfaces in order to press the multifilament yarn into the desired shape. Alternatively, rolls 13 and 14 may have a smooth cylindrical surface if, for example, a flattened multifilament yarn is desired.

Winder section 3 is comprised of freely rotatable guide roll 18, dancer roll 19 connected to a potentiometer for detecting the tension in the multifilament, grooved cam-type traverse roll 20, drive roll 21, and windup roll 22 which moves in a semicircle as the diameter of the spool increases during winding.

Guide roll 18, dancer roll 19 and traverse roll 20 are mounted on a bracket that moves in and out of the plane of FIG. 1 by means of a grooved cam. The rotation of a speed-controlled electric motor 23 is transferred by a suitable means such as a pulley and belt to the grooved cam and driven rolls.

In preparation to operate the apparatus, wound spool or "package" 10 of coalesced multifilament elastomeric yarn is placed onto first rolls 4 and 5 in delivery section 1. The end of coalesced multifilament 24 is taken from spool 10 and passed over guide roll 7, dancer roll 8, and guide rolls 9, 11 and 12; between hot press rolls 13 and 14; over guide roll 18, dancer roll 19, traverse roll 20 and drive roll 21; and is attached to windup roll 22.

Once this preparation is complete, rotation of rolls 4 and 5 is begun, and the coalesced elastomeric yarn is delivered at a preset speed and is hot-pressed between rolls 13 and 14 to form a modified multifilament. During delivery of the elastomeric yarn, the potentiometer detects the displacement angle of dancer rolls 8 and 19, signals are sent to the controls of drive units 6, 17 and 23, and the speeds of the driven rolls and the cam are adjusted.

Elastomeric yarn 24 is hot-pressed between hot press roll 14 (which has been lowered by means of air cylinders 15 and 16) and hot press roll 13. The coalesced multifilament elastomeric yarn 24 becomes modified yarn 25, for example having a flattened shape. The modified yarn is then wound up by means of traverse roll 20, drive roll 21, and windup roll 22 in section 3.

Figure 2:
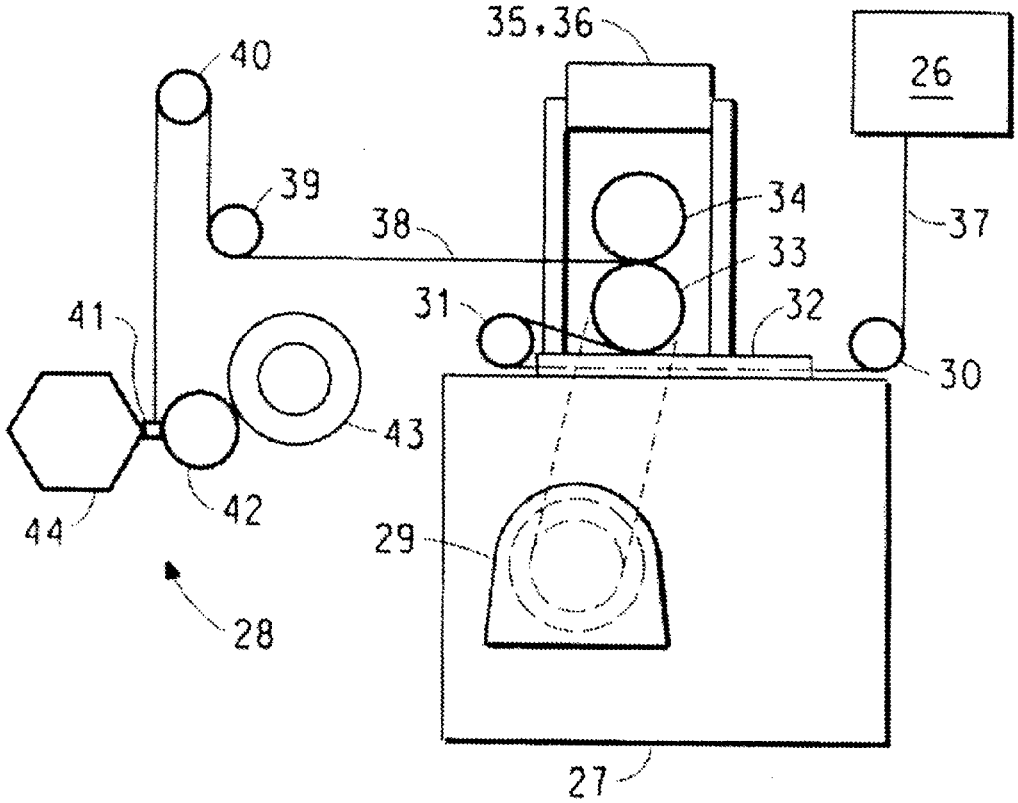
FIG. 2 is a side view of an apparatus that can be used at the bottom of a spinning column in the process of the present invention.

FIG. 2 illustrates direct manufacture of yarn having a modified cross-section by installation of the apparatus used in the process of the present invention between the lower section of the spinning cell and the windup.

Spinning column 26 delivers elastomeric yarn 37 to windup section 28. Modifying section 27, which forms yarn with modified cross-sections, is located between column 26 and windup 28. Modifying section 27, similarly to section 2 of FIG. 1, comprises guide rolls 30 and 31, hot press rolls 33 and 34, air cylinders 35 and 36, drive unit 29 which drives hot-press roll 33, and preheater 32, which uses far-infrared radiation to provide additional heat to the coalesced multifilament elastomeric yarn before it is modified.

Windup section 28 comprises driven rolls 39 and 40, a grooved cam (inside cam box 44), traverse guide 41 which is driven by the grooved cam, drive roll 42, and windup roll 43.

In preparation for operating the process of this invention using the apparatus of FIG. 2, elastomeric yarn 37 is delivered from the lower section of spinning column 26, passed around guide roll 30, through pre-heater 32, around guide roll 31, between hot press rolls 33 and 34, around rolls 39 and 40, through traverse guide 41, around drive roll 42, and finally wound on windup roll 43.

When these preparations have been completed, traverse guide 41 and drive roll 42 in windup section 28 are started up, and cylinders 35 and 36 in modifying section 27 are lowered. Then elastomeric yarn 37 is heated by preheater 32, subjected to hot-press heating by hot-press rolls 33 and 34 where it becomes yarn 38 having a modified cross-section (for example a flat shape), and is eventually wound on roll 43.

FIG. 3 shows examples of modified cross-sectional shapes of various elastomeric yarns (A–G) that have been produced by means of the present invention. The surface of the yarn can also be easily formed by using press rolls having at least one embossed surface. Yarn can easily be formed to have at least one shape selected from among flattened, polygonal, star-like, horseshoe, elliptical and semicircular shapes. The yarn can also have a shape that is a composite of these shapes or a cross-sectional shape that is modified in the lengthwise direction of the elastomeric yarn, for example by use of press rolls that have groove shapes that vary circumferentially around the rolls or that have ridges, embossed patterns, and the like on their circumferences. Hence, the yarn produced by the method of the present invention is not limited to the shapes given as examples here. Moreover, in the illustrated examples, the shapes of the individual filaments are shown here to be substantially circular for the sake of convenience, but in fact the filaments have been deformed by pressure, and the degree of such deformation becomes larger as the magnitude of the pressure increases.

Figure 3A:
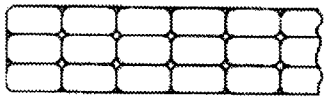
FIGS. 3A–3G illustrate typical cross-sectional shapes of elastomeric yarns that can be produced by the method of the present invention.
Figure 3B:
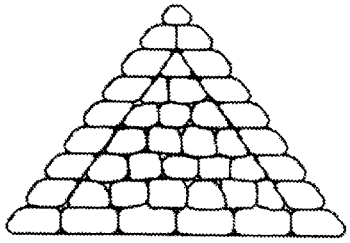
Figure 3C:
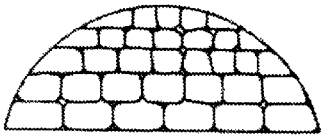
Figure 3D:
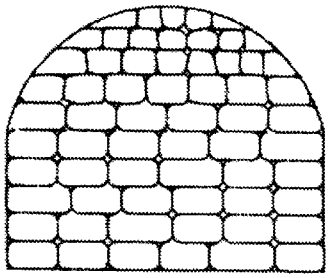
Figure 3E:
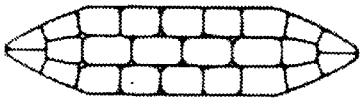
Figure 3F:
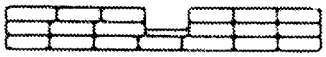
Figure 3G:
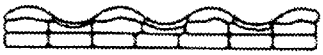
Figure 4:
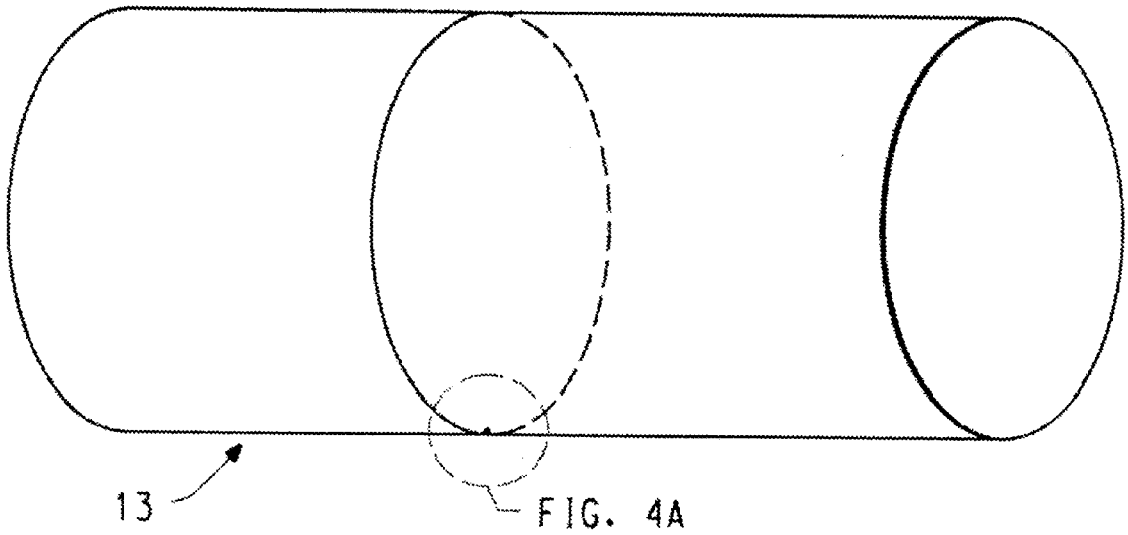
FIG. 4 shows an example of a grooved press roll that can be used in the process of this invention; inset FIG. 4A exemplifies a magnified cross-section of the groove.
Figure 4A:
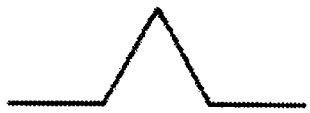

FIG. 4 shows an example of a grooved hot-press roll (13 in FIG. 1). The shape of the groove is not restricted to the shape shown here but may be selected from a wide variety of shapes to obtain the desired cross-sectional shapes as exemplified in FIG. 3.

EXAMPLES

The present invention shall now be illustrated more concretely by means of examples, which are not intended to limit the scope of the invention.

Example 1

First, 2000 g of polytetramethylene ether glycol having a molecular weight of 2000 and 400 g of diphenyl methane diisocyanate (mole ratio of 1.60) were poured into a nitrogen-sealed stirring vessel and reacted at 90° C., thereby giving a prepolymer (or "capped glycol"). Next, 699 g of this prepolymer was dissolved in 1288 g of dimethyl acetamide, following which 11 g of ethylenediamine as the chain extender and 1.6 g of diethylamine as the chain terminator were added so that the molar ratio of such amines to the prepolymer was 1.05. The resulting mixture was stirred at 80° C. and reacted to give a polyurethane solution.

A stabilizer package including titanium dioxide was added and stirred into the polyurethane solution so as to give a weight ratio of 6%, based on polymer.

The number-average molecular weight of the polyurethane thus obtained was determined by gel permeation chromatography to be approximately 38,000 (polystyrene standard). The softening temperature of the polyurethane, as measured by thermomechanical analysis, was 170° C.

The above-described polyurethane solution was heated to 50° C., and using a spinneret having 200 holes, each with a hole diameter (D) of 0.20 mm and a hole length (L) of 0.55 mm, such that L/D=2.75, a total of 22.5 kg of the solution was discharged into the spinning column. The temperature of the sidewalls of the spinning column was 300° C. The drying gas was nitrogen, which was injected at the top of the spinning column at a temperature of 400° C. and a rate of 60 kg per hour.

The polyurethane yarn thus obtained was divided into four filament bundles of 50 filaments each by a tow guide below the spinning column and coalesced within the spinning column by means of pressurized air. The take-off speed was 1000 m/min and the windup speed was 1150 m/min, and so 840-denier polyurethane yarn was wound at a speed ratio (windup speed/take-off speed) of 1.15.

The polyurethane yarn thus obtained was cross-sectionally modified by the method of the present invention at a windup speed of 3 m/min and a hot roll surface temperature of 220° C. The cross-sectional shape of the hot rolls were generally circular, and the pressure applied was 20 kg/cm$^3$. The modified elastomeric yarns thus obtained had shapes like those shown in FIG. 3.

Example 2

The polymer, process conditions, and apparatus were the same as in Example 1 except that hot-press roll 13 was changed to have a groove as shown in FIG. 4. The resulting modified yarn had a cross-sectional shape as shown in FIG. 3B.

Example 3

When the apparatus was used between the spinning column and the windup as shown in FIG. 2, with a cylindrical (no groove) press roll, a pressure of 20 kg/cm2, a preheater temperature of 490° C., and a hot press roll surface temperature of 230° C., yarns having a modified cross-section as shown in FIG. 3A were produced.

We claim:

1. A method for producing shaped elastomeric non-thermoplastic polyurethane yarn comprising the steps of:

bundling a plurality of coalesced multifilament yarns;

heating the bundled yarns to a temperature in the range of 170°–250° C.; and pressing the heated yarns between pressing members to form a yarn having a modified cross-section.

2. The method according to claim 1 wherein the pressing members are parallel cylindrical rolls.

3. The method according to claim 2 wherein the rolls have, incorporated into their cylindrical surfaces, at least one groove to accommodate the yarn and modify the yarn cross-section.

4. The method according to claims 1 or 3, wherein the modified cross-section is selected from the group consisting of flat, polygonal, starlike, horseshoe, elliptical and semi-circular shapes.

5. The method of claim 3 wherein the temperature is in the range of 200°–230° C.

* * * * *